United States Patent [19]

McMains et al.

[11] 4,354,077

[45] Oct. 12, 1982

[54] PUSH-BUTTON PANEL ASSEMBLY INCLUDING AN INDIVIDUALLY LIGHTED PUSH-BUTTON SWITCH ASSEMBLY

[75] Inventors: Billy D. McMains, Garden Grove; Richard G. Mendoza, Downey; Gerald L. Clark, Los Alamitos, all of Calif.

[73] Assignee: Jay-El Products Incorporated, Gardena, Calif.

[21] Appl. No.: 158,566

[22] Filed: Jun. 11, 1980

[51] Int. Cl.[3] ..... H01H 9/18

[52] U.S. Cl. ..... 200/314; 200/292

[58] Field of Search ..... 200/310, 311, 312, 313, 200/314, 317, 292

[56] References Cited

U.S. PATENT DOCUMENTS

| | | | |
|---|---|---|---|
| 3,274,358 | 9/1966 | Hallerberg | 200/317 |
| 3,754,243 | 8/1973 | Kaneko et al. | 200/314 |
| 4,142,168 | 2/1979 | Natland | 200/314 |

FOREIGN PATENT DOCUMENTS

| | | | |
|---|---|---|---|
| 2610077 | 9/1977 | Fed. Rep. of Germany | 200/310 |

*Primary Examiner*—John W. Shepperd

*Attorney, Agent, or Firm*—Edward J. DaRin

[57] ABSTRACT

A push-button panel assembly including an individually lighted push-button switch assembly constructed to be damage resistant and having a long life. The panel assembly utilizes the outer shell as the main structural member and mounts the push-button assemblies and a printed circuit board switching system in precise alignment. The push-button switch assemblies are individually illuminated or edge lighted and permit front relamping of the individually lighted switch. The push-button switch assembly coacts with a precision constructed moisture sealed snap disk system on a printed circuit board for closing a circuit in response to the actuation of the push-button.

10 Claims, 6 Drawing Figures

PUSH-BUTTON PANEL ASSEMBLY INCLUDING AN INDIVIDUALLY LIGHTED PUSH-BUTTON SWITCH ASSEMBLY

The need for a lighted push-button switch that would package in high densities and be of minimal depth has become very apparent in industries using push-button controls. The complexities of the electronics utilized in modern aircraft and similar large systems has created a packaging space problem that necessitated the use of smaller and less space consuming panel mounted components. In the past there has been developed an indicator that was designed to use zero space behind the mounting panel. Such a prior art indicator was designed to mount into, or in conjunction with, a light plate of military specifications and present the same approximate height and appearance unlighted. This prior art indicator, however, utilized dual lamps that produce a high intensity, sunlight readable display. The advantage of these lamps was that they could be removed from the front of the panel without tools by simply unplugging the indicator. This was a significant feature over the prior designs wherein the lamps in the light plate were accessible only by disassembly of the panel and light plate structure. Other developments of the prior art based on these and the aforementioned type of design in a panel assembly included a front relampable and individually lighted push-buttons along with the single pole, double-throw switches for each push-button position. This latter development was a departure from the conventional approach of using a light plate as the basic structure and building push-buttons into the light plate. The basic problems of using a light plate of military specifications as a push-button switch structure have been found to be that the light plates are fragile and, as a result, they chip, crack and mar easily, creating light leaks. The light plates are constructed of an acrylic base material and which material is not good for frictional wear resulting from the continuous manual operation of the push-buttons. In addition, the acrylic base material employed in the prior art cannot be precision molded in large sections to obtain the necessary close tolerances for good key stroke action. The light plate, furthermore, cannot be used as a structural component but, rather, must be supported by additional structural components. Accordingly, there is still a need for an improved lighted push-button panel assembly and push-button switch assembly to provide the same physical advantages as can be realized in a light plate with switching stations, but in a configuration that would overcome the shortcomings and disadvantages of these prior art panels to provide a damage resistant panel assembly having a long life.

The present invention provides an improved push-button panel assembly wherein the basic panel structure is constructed of a machined, or molding, impact and damage resistant shell having all of the push-button positions and for indicating positions required for any one specific application of such a panel assembly. The panel assembly is constructed and defined so that the outer shell comprises the main structural member of the assembly, and is constructed of an opaque, high strength, engineering plastic, such as nylon, or the like, which may have the desired color molded in. The molding operation eliminates light leaks, painting, and associated key problems of prior art panels. The improved panel assembly allows for fast disassembly of the panel.

To this end the novel and improved push-button keys for the panel assembly that are provided may be individually illuminated and are swung upwardly to permit front relamping. Operating wear of the keys does not affect the legends inscribed on the keys, as the legends are reverse-inscribed for permanent durability.

From a structural standpoint the front relampable push-button switch assembly of the present invention comprises a push-button lamp housing having a closed, hollow interior, except for a lamp mounting socket on one side thereof and a pushing surface on the opposite side thereof. A wire lead lamp is mounted in the socket of the lamp housing for illuminating the interior of the lamp housing when the lamp is energized. The selected lamp has stiff wire leads extending away from the lamp in opposite directions so as to be exposed outside of the mounting socket. The actuator housing means is constructed and defined for slidably mounting the lamp housing in one end thereof and including a section slidably coupled thereto at the opposite end capable of relative movement between in response to an operating force applied to the pushing surface. The actuator housing means includes resiliently mounted contact means arranged with the section and extending outside thereof for providing a mechanical electrical contact between the wire leads of the lamp and the contact means to enable the lamp to be energized therethrough. The lamp housing may be removably hinged to the actuator housing to permit exposure and removal of the lamp while maintaining it captive to the actuator housing means.

From a push-button panel assembly standpoint, the invention comprises a precision molded U-shaped outer shell having a plurality of push-button switch mounting apertures defined thereon singley or in rows and columns. Along with the outer cell, a push-button switch mounting plate having a plurality of push-button switch mounting apertures defined singly or in rows and columns corresponding to the rows and columns for the U-shaped shell is provided. A push-button switch actuator is mounted in each of the apertures of the plate with the push-buttons extending outwardly of one side of the plate. Each of the push-buttons mounts a switch operating member at the opposite end to the push button end, light transmitting end. The mounting plate carrying the push-button is mounted in the U-shaped cell with the push-buttons extending towards or through the cell push-button mounting apertures a preselected distance above or below the outer surface of the cell. The panel assembly includes a printed circuit board having a plurality of electro-mechanical switching positions arranged thereon singly or in rows and columns corresponding to the positions of the mounting apertures for the cell, and having a printed circuit deposited thereon in a preselected circuit configuration for pwering the switching positions. The printed circuit board is mounted within the outer shell adjacent the switch actuators on the light transmitting mounting plate and opposite an individual switching position for energizing a contact in response to the application of an actuating force to a push-button moving a switch operating member into engagement with the switching position. The panel assembly is completed by means of a base plate mounted within said cell adjacent the printed circuit board and being secured thereto for securing or covering the thus assembled elements together.

These and other features of the present invention may be more fully appreciated when considered in the light of the following specification and drawings, in which.

Figure 1:
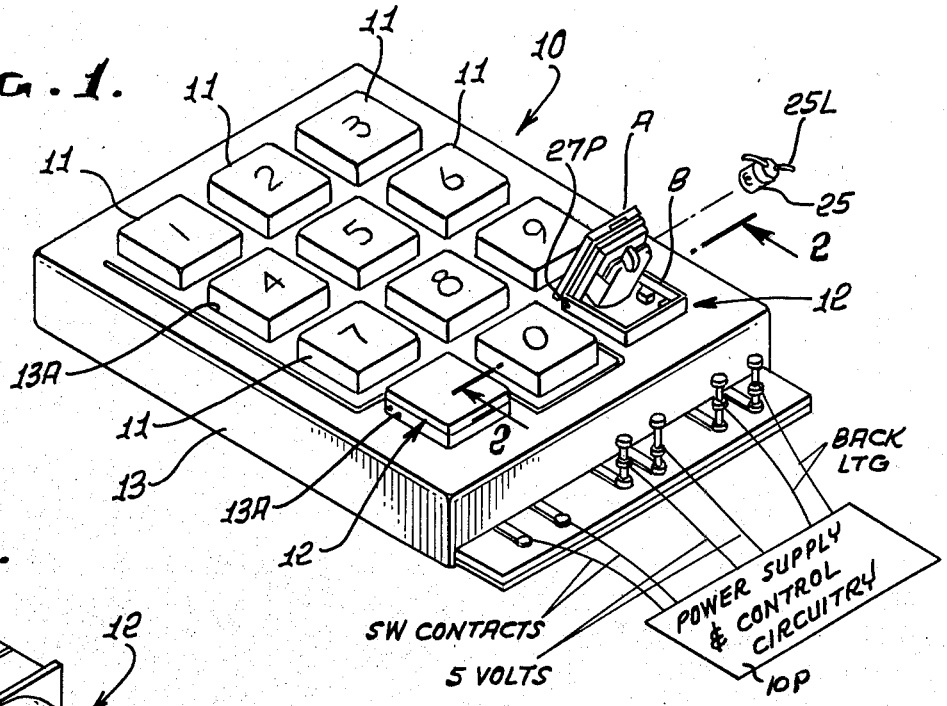
FIG. 1 is a perspective view of a keyboard panel assembly with the power supply and control circuit illustrated as a block embodying the present invention and illustrating the improved push-button keys and with the lamp for the front relamping push-button in an open position and illustrated in an exploded relationship therewith.

Now referring to the drawings, the invention will be described as it is embodied in an improved panel assembly in the form of a keyboard 10 integrating the improved front relampable push-button switch assembly 12 therein. The keyboard 10 is illustrated in FIG. 1 as included an edge lighted push-button switch 11 and the improved, individually lighted push-button switch assembly 12. The conventional push-button switches 11 may be edge lighted switches. The edge lighted switches 11 must be relamped at the printed circuit board level. The push-button switches 11 and 12 are arranged on the shell 13 for the assembly 10 in rows and columns with a number of push-button switches of each type being provided in accordance with the particular application for the keyboard 10. The keyboard 10 is illustrated in FIG. 1 with the individually lighted push-buttons 12 arranged adjacent each lower corner of the keyboard 10 with the remaining push-buttons 11 being an edge lighted push-buttons.

Figure 2:
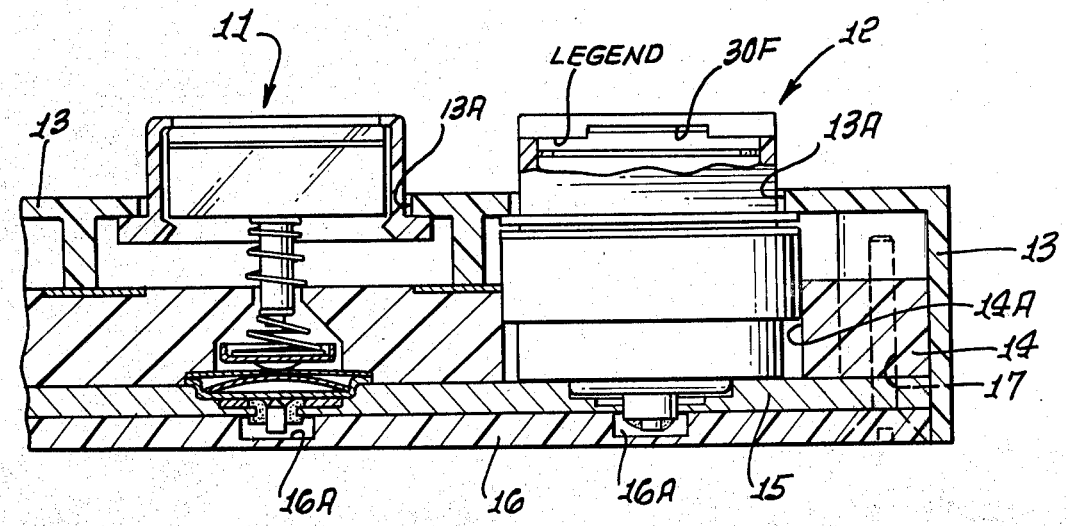
FIG. 2 is a cross-sectional view of the keyboard panel taken along the lines 2—2 of FIG. 1.

The basic element of the panel assembly 10 is the U-shaped outer shell 13. The outer shell 13 is constructed and defined to be the principal structural member of the panel assembly and is preferably constructed by machining or molding an opaque, high strength engineering plastic such as nylon, valox, or an ABS resin. The use of these engineering plastics renders the shell 13 impact and damage resistant and also allows it to house the push-button switches 11 and 12 without light leaking as a result of scratches or damage, or the need for painting, and provides repeatable precision in the key assemblies thereby eliminating the prior art sticking push-button key problems. The remaining elements of the assembly 10, including the push-button switches 11 and 12, may also be constructed of a plastic material. The outer shell 13 has a plurality of key mounting apertures 13A arranged in rows and columns for receiving the top portions of push-button keys 11 and 12 extending through the apertures 13A as illustrated in FIGS. 1 and 2. The apertures 13A are of the same configuration of the topmost portions of the keys 11 and 12, and a illustrated, these keys have a square configuration but could be of any configuration. The square configured, flat portion of the push-button switches 11 and 12 comprise the switch operating surfaces as illustrated and may extend a preselected distance above the top face of the shell 13. The push-button switches 11 and 12 are mounted on a light transmitting mounting plate 14 having apertures 14A arranged in rows and columns corresponding to the locations of the apertures 13A for the shell 13. The apertures 14A for the mounting plate 14 either have a square configuration or another configuration to respectively conform to the outer configuration of the switches 11 and 12. The holding plate 14 is mounted within the shell 13 so that the push-button switches 11 and 12 will extend through the apertures 13A a preselected distance. A printed circuit board 15 is mounted within the shell 13 on the opposite side of the mounting plate 14 from the top surface of the shell 13. The printed circuit board 15 may have a preselected printed circuit pattern deposited on both sides of the board or in multilayer configuration and be constructed in a conventional fashion. The printed circuit pattern (not shown) is defined in accordance with the particular switching requirements for the panel assembly 10. The printed circuit board 15 has a plurality of electro-mechanical switching positions arranged thereon in rows and columns to conform with the rows and columns in the outer shell 13 and the mounting plate 14. The operating members for the push-buttons 11 and 12 are centered over the electromechanical switching positions defined on the board 15. Arranged below the printed circuit board 15 is a base plate 16 provided for completing the assembly. The base plate 16 may be provided with apertures 16A to receive the contacts 41 and thereby accommodate the the printed circuit board 15; see FIGS. 2 and 3. The base plate 15 is secured to the shell 13 by fasteners such as the fastener 17 illustrated in dotted outline in FIG. 2. The fasteners 17 secure the elements of the assembly 10 together in a compact package. It also maybe necessary to additionally secure the mounting plate 14 to the shell 13 by fasteners. These fasteners are not illustrated in the drawing. The board 15 may also carry miniature lamps (not shown) for edge lighting the conventional push-button 11.

Figure 4:
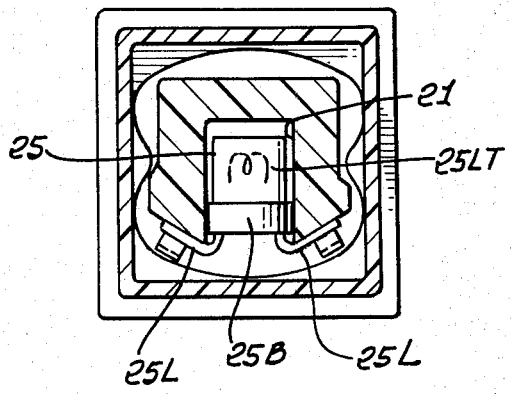
FIG. 4 is a cross-sectional view taken along the lines 4—4 of FIG. 3.
Figure 6:
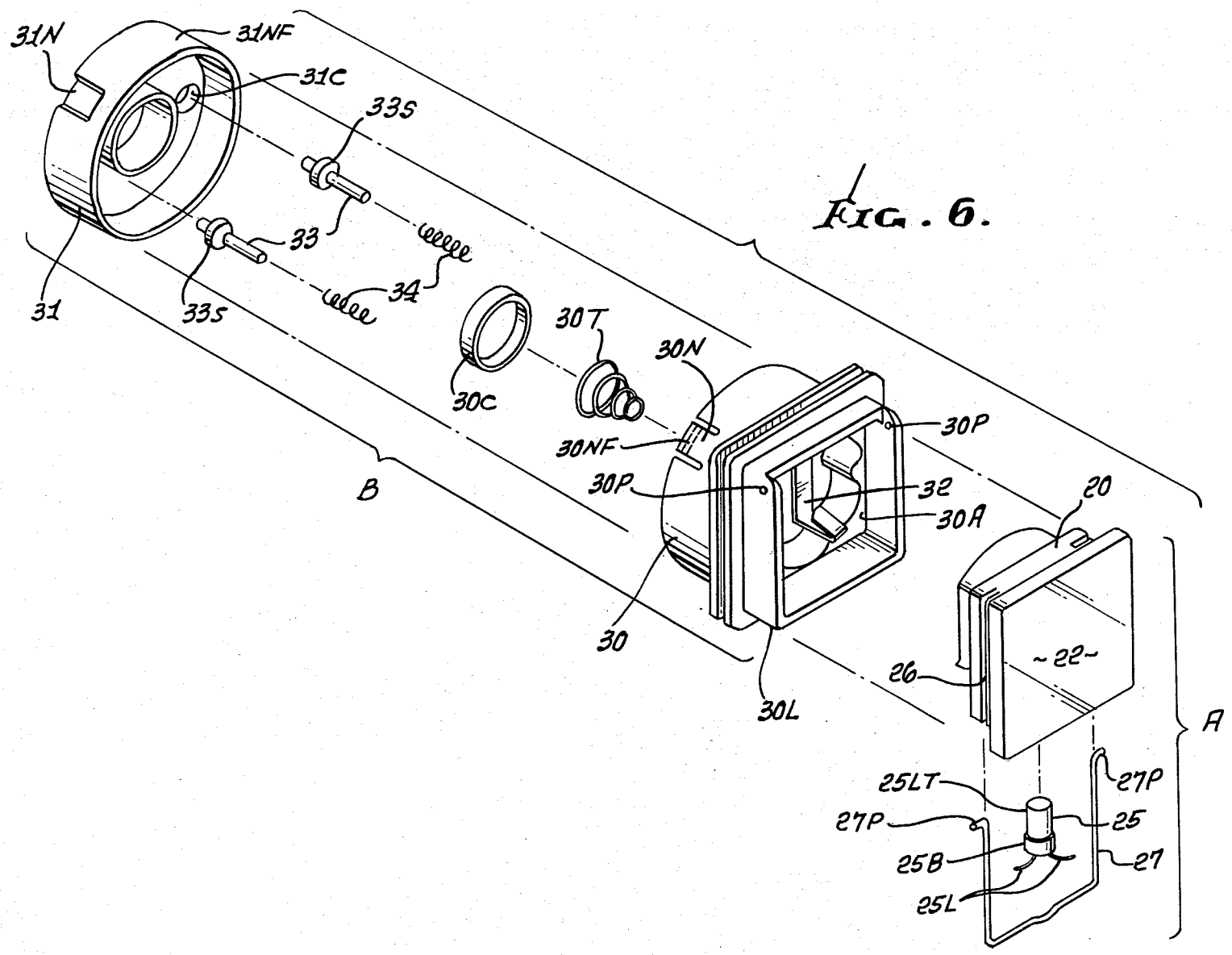
FIG. 6 is an exploded view of the front relampable push-button switch assembly illustrated in FIG. 3.

The detailed construction of the improved push-button assembly 12 will be described with reference to FIGS. 3, 4 and 6, for use with electro-mechanical switching positions defined on the printed circuit board 15. The push-button 12 is defined by means of two basic elements, a lamp capsule or housing A, and an actuator housing means B; see FIG. 6. The lamp capsule or housing A is constructed as a unit for hinged or swinging coaction with the actuator housing B to permit the lamp to be replaced, or the lamp capsule housing A to be replaced in its entirety.

The push-button lamp housing A comprises an integral body 20 having a closed, hollow interior, except for a lamp mounting socket 21 for snugly receiving a lamp 25 therein. On the side of the body 20 opposite the lamp mounting socket 21 there is defined, a pushing or operating surface 22 to accommodate a finger for operating the push-button 12. The operating surfaces 22 shown are of a square configuration and flat to accommodate a finger for operating the push-button 12 but may be of other configurations and have surfaces other than flat. The lamp mounting socket 21 is constructed and defined relative to a wire lead miniature lamp 25 to snugly receive the lamp therein so that the light transmitting portion 25 LT of the lamp will extend completely within the interior of the body 20 with only the base portion 25B of the lamp 25 being visible. The lead wires 25L for the lamp 25 extend out of the base portion 25B and are bent at approximately 90 degrees to the axis of the lamp proper to be mounted in the lamp capsule A in the desired relationship. The lamp 25 is of a commercially available construction, except that the leads 25L have been bent for the purposes of the present invention. It is preferable to use a conventional bi-pin lamp since the leads 25L therefore are relatively stiff. When mounted in the lamp mounting socket 21, only the base 25B is visible and the leads 25L are mounted within the longitudinal slots 20S arranged and defined on opposite sides of the lamp mounting socket 21 and in communication therewith so as to readily accommodate the lead wires 25L, as best illustrated in FIG. 3.

The body 20 is further defined with a U-shaped latch receiving aperture 26 intermediate the lamp socket 21 and the operating surface 22. The latch receiving aperture 26 conforms to the configuration of the U-shaped latch 27 to snugly receive and secure the latch therein. The latch 27 is utilized as a hinging element for permitting the lamp capsule or housing A to be pivoted relative to the actuator housing means B. To this end the latch 27 has a general U-shaped configuration with the free ends of the arms of the U bent at approximately 90 degrees to provide a means of attachment to the actuator housing means B. These ends are identified in FIG. 6 as the ears 27P. It should be recognized that the relationship of the capsule housing A and the actuator housing B are such that the latch 27 can be released from the housing B to permit the capsule A to be removed in its entirety. This function is in addition to the ability to remove the lamp 25 from its socket 21 when the capsule A is swung to an open position as illustrated in FIG. 1. The inside surface of the body 20 within the hollow portion below the flat operating surface 22 may be inscribed with a legend for the particular use of the push-button switch 12. The legend is not illustrated in the drawings and may be visible or not visible through the operating surface 22 except when the interior of the capsule A is illuminated in response to the energization of the lamp 25. The inscription of the operating surface 22 of the switch 12 in this fashion allows the switch to be used over a long period of time without damaging the inscription thereon due to the frictional wear of an operating finger passing thereover.

Figure 3:
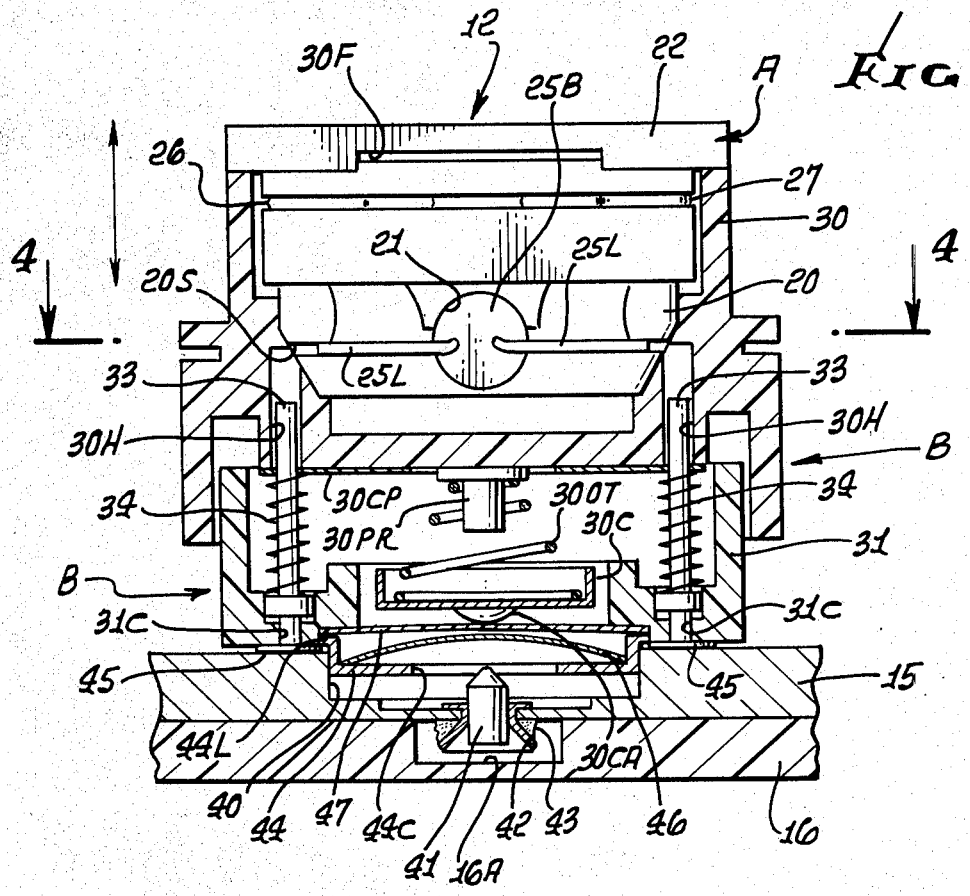
FIG. 3 is a cross-sectional view of the push-button switch assembly utilized in the keyboard panel of FIG. 1.

For ease in opening the lamp capsule A the front edge 30F of the operating surface 22 may be slightly undercut, as illustrated in FIG. 3, at the area intermediate the ends of the surface 22 for accommodating a fingernail to allow the capsule A to be more readily detached from the housing B to be swung to an open position.

The actuator housing means B comprises a body element 30 coacting with a base element 31 for housing and mounting an actuating cup 30C and for hingedly receiving and mounting the lamp capsule or housing A. For this latter purpose, the body element 30 is shown as having a square shaped top opening 30A having hinge apertures 30P defined adjacent the back corners thereof for accomodating and securing the ears 27P of the latch 27 for hingedly securing the capsule A thereto. The capsule A is completely enclosed within the opening 30A at the top side of the body 30 and is slidably housed therein with only the operating surface 22 extending above the top surface of the body 30, as illustrated in FIG. 3. To this end the fingernail notch 30F for the operating surface 22 will be arranged immediately above the top surface of the body 30 when the capsule A is in a closed position. The interior of the body 30 has a pair of electrically conductive strips 32 secured thereto for providing an electrical circuit path for the leads 25L of the lamp 25. One such strip is identified in FIG. 6 as the element 32 and has one end secured to the bottom of the opening 30A for the body 30 by a rivet (not shown) and arranged in a preselected configuration so as to provide a wiping contact with the leads 25L for the lamp 25 when the capsule A is mounted in the closed position with respect to the body 30. This provides an electrical circuit to the lamp 25 by means of mechanical contact between the wiping strips 32 and the lead wires 25L for the lamp 25. On the bottom side of the body 30 conductive strips 30CP are mounted and secured to be in circuit relationship with the conductive strips 32. The conductive strips 30CP are individually secured to the corresponding strips 32 on the opposite side by the same rivet. The body 30 also carries a push rod 30PR arranged thereon centrally, between the conductive pads 30CP. The push rod 30PR secures one end of an overtravel spring 30OT. The spring 30OT has its opposite end secured to the inside of the switch actuator 30C. This arrangement permits the actuator 30C to move in response to the actuation of the body 30. The cup-shaped switch actuator 30C has a dome-shaped actuating portion defined centrally thereof and is identified by the reference number 30CA; see FIG. 3. The switch actuator 30C is designed to move outwardly of the base element 31 in response to actuating pressure causing the base element 31 and body portion 30 to assume a telescoped relationship.

The bottom portion of the body 30 is of a circular configuration and is defined with an extending lip 30L arranged intermediate the top square portion and the bottom circular portion of the body 30. The lip 30L forms a mounting ledge for mounting the switch 12 on the shell 13 and prevents the push-button switch 12 from being extruded completely through the mounting aperture 13A on the shell 13 and contains a receiver groove for a moisture seal. The bottom circular portion of the body 13 has a diameter to slidably receive the base element 31 therein in a telescoped fashion. To this end the base portion 31 is provided with guide slots 31N at four equally spaced positions around the circumference similar to the slot 31N illustrated in FIG. 6. These guide slots 31N are accommodated by similar male elements 30N defined at the bottom end of the body portion 30 and are slidably received within the notches 31N. The elements 31N are each provided with a flange 31NF defined adjacent the outer ends and extending inwardly of the elements 30N to permit the body portion 30 and the base element to be snapped together at the flange 31NF for slidably securing the two elements together. When these two elements are secured in this fashion they can also be pulled apart or unsnapped. Within the secured assembly of the body 30 and base element 31 there is housed a pair of spring mounted contact pins 33. The contact pins 33 extend in apertures in the body portion 30 identified by the reference numeral 30H and corresponding apertures 31C in the base element 31. As illustrated in FIG. 3 the contact pins extend through the contacts 30CP and into the apertures 30H of the body 30. The contact pins 33 are each defined with a shoulder 33S defined adjacent one end for seating one end of a contact spring 34 also functioning as a return spring. The contact springs 34 are mounted on the contact pins 33 so as to have one end seated against the shoulder 33S and the opposite end seated against the contacts 30CP on the body 30, as clearly illustrated in FIG. 3. The pins 34 have a length so that they extend outwardly of the bottom of the base element 31. When the outer end of the pins 34 are electrically connected to a power source, an electrical circuit is always maintained to the lamp 25 through the pins 33 and springs 34, contacts 30CP and 32, and the lead wires 25L for the lamp 25. In FIG. 3 the outer ends of the pins 33 are illustrated to have a pressure contact with the printed circuit pattern on the board 15. In this arrangement there is no loss of electrical contact with the printed circuit with the movement of the actuator housing B.

The electrical contact that is made by operating the push-button 12 is located on the printed circuit board 15. The electrical contact is defined by precisionally formed and located elements mounted on the printed circuit board 15. To this end the printed circuit board 15 has a cavity 40 defined thereon in precise alignment with the center line of the push-button 12 and, more specifically, the actuator cup 30C. The printed circuit board 15 is formed with an electrical contact, or pin 41, that is precisely positioned at the center of the cavity 40 of the printed circuit board to allow an exact overtravel of the switching elements, as will be described immediately hereafter. The contact pin 41 is secured to the rear of the printed circuit board 15 by means of a fillet element 42 and solder 43 securing the center contact 41 to the board 15. A formed metal cup 44 having a precision cavity is mounted on the printed circuit board 15 at the top portion of the opening 40. The metal cup 44 has a small lip 44L that is secured to the top portion of the printed circuit board 15 so as to take in electrical contact with printed circuit pads 45. The pads 45 are arranged on the opposite sides of the cavity 40 so as to provide an electrical circuit between the pads 45 by means of the precision metal cup 44. In its normal relationship the cup 44 has a central aperture 44C and has a diameter to space the center contact 41 from the cup 44 so that there is no circuit path between the center pin 41 and the cup 44. A snap disk 46, comprising a small round, thin, metal disk formed so that it may snap over center when pressed on the center region thereof, is mounted within the inside of the cup 44 with its edges against the lower edges of the cup to assume a dome-like configuration, as illustrated in FIG. 3. It should be recognized that, although one snap disk 46 is illustrated, one, two, or three similar disks could be stacked together to function in unison in response to pressure applied to the assembled disks at its center point. The characteristic of the snap disk 46 is that it responds to the pressure applied at the center point to snap, or flex, downwardly to contact the center pin 41 and thereby bridge the circuit through the cup 44 between the pads 45. In the arrangement illustrated in FIG. 3 a flexible synthetic seal sheet 47 is secured to the edge of the cup 40 adjacent its lip 44L and is utilized to protect the electrical contacts from moisture, or other environmental contaminations. In some applications it may be found advantageous for a mylar or similar plastic disk having approximately the same dimensions as the snap disk 46 to be interposed between the synthetic seal 47 and the disk 46 to prevent the adhesive-backed seal sheet 47 from sticking to the snap disk 46.

Figure 5:
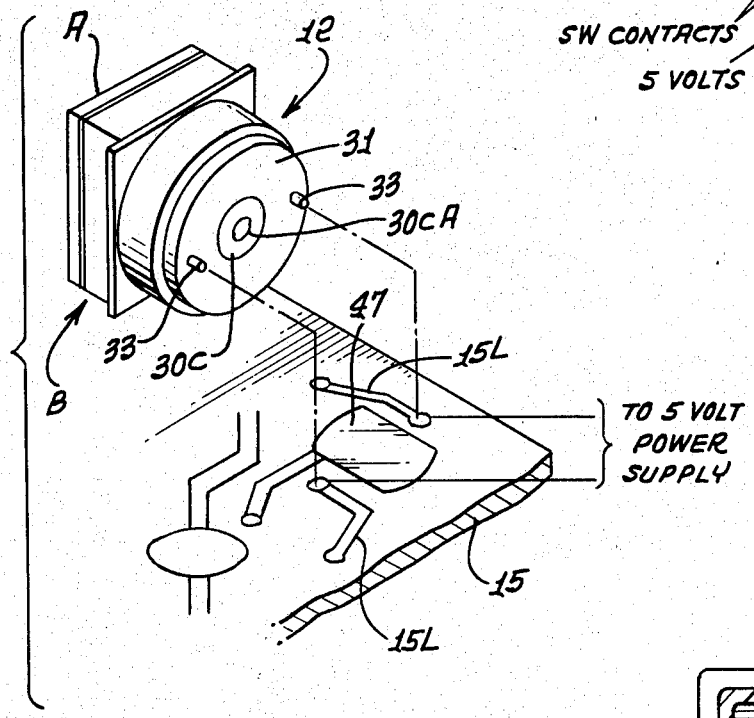
FIG. 5 is an exploded view of a detached front relampable push-button switch assembly and a portion of a printed circuit board arrangement illustrating the manner of powering the lamp in the push-button switch assembly.

It should be noted at this point, and as will be evident from examining FIG. 5, the connection between the printed circuit board circuit and the center pin 41 is defined to be different from that for the pins 33. The conductive pads on the printed circuit board 15 for defining the conductive path through the contact pins 33 are the pads 15L defined on the board 15, as illustrated in FIG. 5. The contact pins 33 are touching on the pads 15L to provide a mechanical pressure, electrical connection to the pad 15L. The contact pins 33 are always maintained in conductive relationship with the pads 15L during the operation of the push-button 12, as mentioned hereinabove. The pads 15L are connected to a 5 volt power supply for powering the lamp 25. When the push-button switch 12 is mounted with the board 15 the plastic seal 47 is arranged in engagement with the domed portion 30CA of the cup actuator 30C at the precise center thereof. The provisions of the contact springs 34 not only function to return the actuator housing B to its normal position after the actuating pressure is removed therefrom, but also maintains sufficient pressure on the printed circuit pads 15L and the contacts 30CP at all times so there is no loss of electrical contact with the movements of the actuator housing means B.

With the above structure in mind, then, the operation of the push-button 12 will be examined including the manner in which the lamp 25 is energized from the power supply 10P. It should now be recognized with the lamp 25 properly mounted into the lamp capsule A that when the capsule is in its closed position the lead wires 25L thereof will be in electrical contact with the wiping contacts 32 which, in turn, maintain contact with the pads 30CP on the bottom of the body portion 30 and thereby engage the contact springs 34 mounted on the conductive pins 33. The electrical circuit thus defined from the power supply 10P through the printed circuit pads 15L and the pins 33 always maintain the lamp 25 energized.

When it is necessary to replace the lamp housed in the capsule A it may be pivoted upwardly to expose the lamp 25, and the lamp can be readily withdrawn from its socket 21 and replaced. If it is desired to utilize a different legend for the switch 12 the entire element A may be removed by removing the ears 27P of the latch 27 from the pivot apertures 30P for the element 30 and another element A may be pivotally positioned therein having the desired legend thereon.

As can be appreciated from examining FIG. 3, with the push-button 12 arranged in its normal position and the capsule A closed, there will be no electrical circuit through the center pin 41, due to the spacing between the snap disk 46 and the center pin 41 preventing an electrical circuit therethrough. When the operator applies an actuating force to the top surface 22 of the push-button 12, the force is transmitted therethrough to cause the body element 30 to move downwardly in response thereto. This will cause the actuator cup 30C to move downwardly to engage first the seal 47 and then the flexible disk 46, at the centers thereof, so that they will snap over center and cause the disk 46 to bridge the circuit between the cup 44 and the pin 41. Since this electrical circuit is connected to be an open switch circuit the operation of the push-button 12 in this manner closes the circuit.

The actuating cup 30C is provided with the overtravel spring 30OT fixed to one end thereof allows an overtravel stroke for the push-button 12 and stores the spring energy that keeps the snap disk 46 contact in their overcenter actuated position when slight variations occur in the actuation pressure applied at the surface 22 at the bottom of the actuation stroke.

It should now be appreciated that the net result of this assembly is a precision device and not a hand-machined assembly, and results in a damage resistant, long life, panel assembly having significant advantages over the concept of a light plate having hand-held calculator switches therein.

It should also be noted that any indicating areas, knob rotation areas, lines, symbols, or other indicia, that needs to be illuminated may be provided on the front surface of the shell 13 by providing molded window areas that have reverse front inscribed characters as desired. Lighting may be provided by a light guide or light transmitting mounting plate under the front shell for these indicating areas, and are illustrated in FIG. 2. In addition, it should be appreciated by those skilled in the art that color filters can be added either to the indicating portions of the panel face, or the push-buttons.

As an alternative feature, a snap-on front cover for the surface 22 provides a capability of a replaceable or interchangeable legend plate and colored filter system, if desired.

The conventional push-button switch 11 is illustrated in FIG. 2. The switch 11 is not individually lighted but the actuation system is basically the same in response to the actuating force applied thereto. The electrical contact system for the switch 11 is the same as described for the push-button switch 12, as is evident from FIG. 2.

What is claimed is:

1. A push-button switch assembly for a keyboard comprising a lamp capsule having a closed, hollow interior constructed and defined by an operating surface on one side thereof and a lamp mounting socket on the opposite side thereof for slidably receiving a wire lead lamp to permit the lamp to extend within the capsule interior for illuminating the hollow interior of the capsule, a wire lead lamp having a light transmitting end and a non-light transmitting base portion, the base portion having the lamp wire leads extending outwardly therefrom and bent to extend outwardly from opposite sides of the base portion, said lamp being slidably mounted in said mounting socket with only the bottom of the base portion being visible and with the wire leads overlying said opposite side of the lamp capsule, housing means for the lamp capsule including a body portion having a lamp capsule receiving socket defined at one end thereof for slidably receiving the lamp capsule therein to permit only the operating surface to be exposed outside of the housing body portion when it is positioned within said socket to thereby close off said socket, means for swingably mounting said lamp capsule to said housing body portion to permit the lamp capsule to be moved between an open and closed position relative to the capsule receiving socket and to expose said lamp when in the open position, the capsule receiving socket for the body portion mounting a pair of wiping electrical contacts therein for inter-engagement with the lead wires of the lamp when the lamp capsule is in a closed position to provide an electrical conductive circuit for energizing the lamp, the opposite end of the housing body portion slidably mounting an enclosed push-button base means for permitting relative movement between the body portion and the base means, said base means comprising a pair of resiliently mounted electrical contact pins having ends extending outside of the base means at the end opposite from the body portion, the outside of the body portion having an electrical conductive segment defined thereon in electrical conductive relationship with said wiping contacts and in electrical conductive relationship with said contact pins to permit the lamp to be continuously energized therethrough, said base means housing a resiliently mounted switch actuator secured to said housing body portion and adapted to be responsive to a force applied to the operating surface of the body portion to be moved therewith for transmitting a switch operating motion through said base means; the relative movement between the body portion and the base means for said housing placing said elements of the housing in a telescoped relationship.

2. A push-button switch assembly as defined in claim 1 including a legend marked on the inside of the operating surface of the lamp capsule to be rendered visible only when the lamp is energized.

3. A push-button switch assembly as defined in claim 1 wherein said operating surface is a flat, button-like surface for receiving a finger for operating the push button, and said swingable mounting means is further characterized as a removable, hinge means permitting the lamp capsule to be detached from said housing body portion without disassembly of said push-button switch assembly.

4. A push-button panel assembly comprising a U-shaped cell having a plurality of switch mounting apertures defined thereon in rows and columns, a switch mounting plate having a plurality of switch mounting apertures defined in rows and columns corresponding to the rows and columns for said U-shaped cell, a push-button switch actuator mounted in each of said apertures with the push-buttons extending outwardly of one side thereof, each of the push-buttons mount a switch operating member at the end opposite to the push-button end, said mounting plate being mounted in the U-shaped cell with the push-buttons extending through the cell mounting apertures a preselected distance above the outer surface of said cell, a printed circuit board having a plurality of electromechanical switching positions arranged thereon in rows and columns corresponding to the positions of the mounting apertures for said cell and a printed circuit deposited thereon in a preselected circuit configuration for powering the switching positions, said printed circuit board being mounted within said cell adjacent the switch actuators on said mounting plate and opposite an individual switching position for energizing a contact in response to the application of an actuating force to a push-button by moving a switch operating member into engagement with a switching position, a base plate mounted within said cell adjacent the printed circuit board and being secured to said cell for securing the thus assembled elements together, at least one of said push-button switch actuators include a push-button lamp housing having a closed, hollow interior except for a lamp mounting socket on one side thereof and a pushing surface on the opposite side thereof, a wire lead lamp mounted in said socket for illuminating the interior of the lamp housing when the lamp is energized, the lamp having wire leads extending away from the lamp in opposite directions outside of said mounting socket, and actuator housing means including a body section constructed and defined for mounting said lamp housing in one end thereof and including a base section slidably coupled to said body section for the actuator housing means at the opposite end from said mounted lamp housing and permitting relative movement between the body section and said base section in response to an operating force applied to said pushing surface, said actuator housing means including resiliently mounted contact means for providing a mechanical, electrical contact to enable the lamp to be energized therethrough, and electrical contact means arranged between said resiliently mounted contact means and the wire leads for the lamp for completing the circuit path to the lamp, said resiliently mounted contact means being further arranged in electrical contact with the lamp and a printed circuit on said board connected for electrically powering the lamp, said resiliently mounted contact means not losing contact with said printed circuit with the movements imparted to said actuator housing means.

5. A push-button panel assembly as defined in claim 4 wherein each electro-mechanical switching position comprises a switching position aperture defined on the printed circuit board, an electrical pin contact precisionly positioned and secured to said board substantially centrally of the aperture, a conductive disk retaining element being mechanically secured to the board and in electrical conducting relationship with said printed circuit on one side of said board, said disk retaining element having a central aperture through which said precision positioned pin contact extends in a spaced relationship therewith, said pin contact being electrically connected with a printed circuit on the opposite side of said board from said retaining element, a snap disk mounted inside said disk retainer in domed, spaced relationship with said precision positioned pin contact and being responsive to the engagement of a push-button actuator to snap into electrical contact with the pin contact upon the application of an actuating force to the push button, and a seal sheet for protecting the electrical contacts from environmental contamination being mounted over the snap disk and said retainer and secured to said printed circuit board.

6. A push-button panel assembly as defined in claim 5 wherein said U-shaped cell is constructed and defined of a molded opaque, high strength engineering plastic such as nylon, valox, or ABS resin.

7. A push-button panel assembly as defined in claim 4 wherein said resilient mounted contact means comprises contact pin means having a shoulder adjacent one end and mounting spring means thereon, one end of the spring means being seated on said pin shoulder.

8. A push-button switch assembly for a keyboard comprising a lamp capsule having a closed, hollow interior constructed and defined by an operating surface on one side thereof and a lamp mounting socket on the opposite side thereof for slidably receiving a wire lead lamp to permit the lamp to extend within the capsule interior for illuminating the hollow interior of the capsule, a wire lead lamp having a light transmitting end and a non-light transmitting base portion, the base portion having the lamp wire leads extending outwardly therefrom and bent to extend outwardly from opposite sides of the base portion, said lamp being slidably mounted in said mounting socket with only the bottom of the base portion being visible and with the wire leads overlying said opposite side of the lamp capsule, housing means for the lamp capsule including base means and body portion, said body portion having a lamp capsule receiving socket defined at one end thereof for slidably receiving the lamp capsule therein to permit only the operating surface to be exposed outside of the housing body portion when it is positioned within said socket to thereby close off said socket, means for swingably mounting said lamp capsule to said housing body portion to permit the lamp capsule to be moved between an open and closed position relative to the capsule receiving socket, and to expose said lamp when in the open position, the capsule receiving socket for the body portion mounting a pair of wiping electrical contacts therein for interengagement with the lead wires of the lamp when the lamp capsule is in a closed position to provide an electrical conductive circuit for energizing the lamp, the opposite side of the capsule receiving socket for the body portion having conductive segments connected in electrical conductive relationship with said wiping contacts, soil base means slidably coupled to the opposite end of the body portion of the housing means from the capsule receiving end, said base means housing a pair of contact pins mounting compression spring means thereon in electrical conducting relationship with said conductive segments to permit the lamp to be energized through the contact pins, the contact pins extending a preselected distance out of said base means to permit an electrical connection to be made thereto outside of said base means, said base means having a central aperture at its outer end, a switch actuator secured to said opposite side of the body portion from said lamp capsule for movement therewith in response to the application of an actuating force to the operating surface of the lamp capsule producing relative telescoping movement between said body portion and said actuating means to thereby cause the switch actuator to move through said central aperture of the base means for transmitting a switch operating motion by means of said switch actuator.

9. A push-button panel assembly as defined in claim 8 wherein said switch actuator has a cup-like shape with a dome-like switch operating protrusion defined substantially centrally on the outside of the actuator, an overtravel spring having one end seated within said cup-like actuator and the other end secured to said body of the housing means portion for movement therewith.

10. A push-button panel assembly as defined in claim 9 wherein said base means and said body portion are snap-locked together for relative sliding movement.

* * * * *

UNITED STATES PATENT AND TRADEMARK OFFICE

CERTIFICATE OF CORRECTION

PATENT NO. : 4354077

DATED : October 12, 1982

INVENTOR(S) : Billy D. McMains, Richard G. Mendoza & Gerald L. Clark

It is certified that error appears in the above-identified patent and that said Letters Patent is hereby corrected as shown below:

Column 1, line 57, change "molding" to -- molded --;

Column 2, line 54, change "pwering" to -- powering --;

Column 3, line 27, change "included" to -- including --;

line 62, change "a" first occurrence, to -- as --;

Column 12, Claim 8, line 34, change "soil" to -- said --

Column 12, Claim 9, line 60, after "body" insert -- portion -- line 61, after "means" delete -- portion --

Signed and Sealed this

*Twelfth* Day of *April 1983*

[SEAL]

*Attest:*

GERALD J. MOSSINGHOFF

*Attesting Officer*

*Commissioner of Patents and Trademarks*